US005469966A

United States Patent [19]

Boyer

[11] Patent Number: 5,469,966

[45] Date of Patent: Nov. 28, 1995

[54] INFLATABLE PACKAGE WITH VALVE

[76] Inventor: Geoffrey Boyer, 9 Foursome Crescent, Toronto, Ontario, Canada

[21] Appl. No.: 204,093

[22] Filed: Mar. 2, 1994

Related U.S. Application Data

[63] Continuation-in-part of Ser. No. 907,657, Jul. 2, 1992, abandoned.

[30] Foreign Application Priority Data

Jul. 5, 1991 [CA] Canada ..... 2046418

[51] Int. Cl.[6] ..... B65D 81/02; B65D 30/26

[52] U.S. Cl. ..... 206/522; 383/3; 383/44; 383/48; 383/53

[58] Field of Search ..... 206/522; 383/3, 383/44, 47, 48, 53, 58, 100, 101

[56] References Cited

U.S. PATENT DOCUMENTS

| | | | |
|---|---|---|---|
| 3,197,073 | 7/1965 | Gondra et al. | 383/44 X |
| 3,207,420 | 9/1965 | Navarrete-Kindelan | 383/44 X |
| 3,346,101 | 10/1967 | Pestka . | |
| 3,384,294 | 5/1968 | Astle | 383/44 |
| 3,806,025 | 4/1974 | Marshall | 383/44 X |
| 3,904,107 | 9/1975 | Nishimura et al. . | |
| 4,465,188 | 8/1984 | Soroka et al. . | |
| 4,674,532 | 6/1987 | Koyanagi . | |
| 4,850,912 | 7/1989 | Koyanagi . | |

FOREIGN PATENT DOCUMENTS

| | | | |
|---|---|---|---|
| 202662 | 6/1954 | Australia . | |
| 251418 | 11/1964 | Australia . | |
| 28091 | 11/1984 | Australia . | |
| 31116 | 2/1985 | Australia . | |
| 255780 | 2/1988 | European Pat. Off. . | |
| 2067530 | 8/1971 | France . | |
| 2291114 | 6/1976 | France . | |
| 0019283 | 1/1990 | Japan | 383/3 |
| 88/06131 | 8/1988 | WIPO | 383/3 |
| 90/04554 | 3/1990 | WIPO . | |
| 91/00834 | 1/1991 | WIPO . | |

OTHER PUBLICATIONS

Coussin d'air Airchain (2 pages—brochure).

*Primary Examiner*—Bryon P. Gehman
*Attorney, Agent, or Firm*—Hoffman, Wasson & Gitler

[57] ABSTRACT

There is described an improved inflatable package comprising outer deformable walls defining at least one fluid-tight chamber therebetween, and a one-way valve disposed within the chamber, to be in fluid communication therewith, the valve permitting the ingress of fluid into the chamber, and preventing the egress of fluid therefrom, the valve including a primary duct and at least one flow channel intersecting the primary duct at an angle to place the primary duct in fluid communication with the interior of the chamber.

19 Claims, 9 Drawing Sheets

INFLATABLE PACKAGE WITH VALVE

This is a continuation-in-part of application(s) Ser. No. 07/907,657, filed on Jul. 2, 1992, now abandoned

TECHNICAL FIELD

The present invention relates to an inflatable package and more particularly to a self-sealing, fluid inflatable package for use as a hot/cold pack or for the packing of fragile objects for shipment. The invention further relates to a one-way multiple valve construction having self-sealing properties.

BACKGROUND ART

In the food industry, keeping food fresh during shipment often requires that it be kept on ice. Single chamber plastic sacks, filled with water and then frozen, are often used during shipping. These sacks are typically of a single size and shape and thus are of limited adaptability to varying storage and shipping demands. Accordingly, it is clear that an ice pack that is more readily adaptable to differing demands would be an attractive feature for users of these devices in keeping objects cold during shipment. Similar considerations apply in relation to domestic users of ice/hot packs in coolers or other temporary storage media.

Furthermore, when shipping fragile objects, keeping the object well cushioned is important to limit damage due to impact or vibration. Currently, styrofoam "chips", injected styrofoam mouldings, "bubble" mats, popcorn and other energy absorptive materials are used to cushion fragile objects for shipment. Styrofoam mouldings are limiting as such cushioning can only be reused for objects of the exact original shape and size. Styrofoam "chips", popcorn and other packing particulates are messy and may settle during transportation, thus offering no cushioning effect to the object. Popcorn may attract insects and other vermin. Bubble mats when wrapped around an object do not securely hold that object without the aid of tape or some other binding. All the above-described packaging materials are themselves voluminous to both ship and store, and all create waste disposal problems with attendant problems of environmental degradation. Accordingly, it is clear that a device is needed that is self-adapting to the size and shape of the object being packed, will not settle during shipment, that will by its very nature secure itself around the object, that is itself easy to ship and store, is readily reusable or at least easily disposable and of course is cost competitive with existing systems.

DISCLOSURE OF THE INVENTION

It is an object of the present invention to obviate and mitigate from the disadvantages associated with known ice packs and packaging media and provide an effective and easy to use device. In one broad aspect, the present invention relates to a plastic self-sealing package that can be easily filled with either air or liquid to function as either a hot/cold pack or as a packing medium. In another broad aspect, the present invention relates to a one-way self-sealing valve that operates between the package and the exterior environment as well as between one or more interconnected chambers. In a further broad aspect, the present invention relates to a process for manufacturing the self-sealing package and the various other related embodiments of this invention. These various forms allow for the package to be produced for the least possible cost per linear foot while still maintaining adequate structural integrity to the complete system.

According to the present invention, there is provided an inflatable package comprising outer pliable walls of indefinite length, said walls being joined along their opposed longitudinal edges and along spaced apart seams extending transversely between said longitudinal edges thereby defining a plurality of chambers between said outer walls, and valve means disposed in longitudinal alignment between said outer walls for permitting the ingress of pressurized fluid into said chambers, said valve means comprising opposed layers of pliable film sealed together to define therebetween a primary fluid duct extending continuously along the length of said valve means, and a plurality of spaced apart flow channels intersecting said primary duct at an angle to extend transversely from said primary duct, a respective at least one of said flow channels placing said primary duct in fluid communication with the interior of respective ones of said chambers, said primary duct and flow channels being collapsible into a substantially flattened sealed condition when the ingress of pressurized fluid terminates to prevent the egress of said fluid from said chambers, the lateral distance between centres of adjacent flow channels being sufficiently less than the width of respective ones of said chambers so that each of said chambers is placed in fluid communication with said primary duct via at least one of said flow channels without need of registration of said flow channels relative to said chambers.

BRIEF DESCRIPTION OF DRAWINGS

Preferred embodiments of the present invention will now be described in greater detail and will be better understood when read in conjunction with the following drawings in which.

BEST MODE FOR CARRYING OUT THE INVENTION

Figure 1:
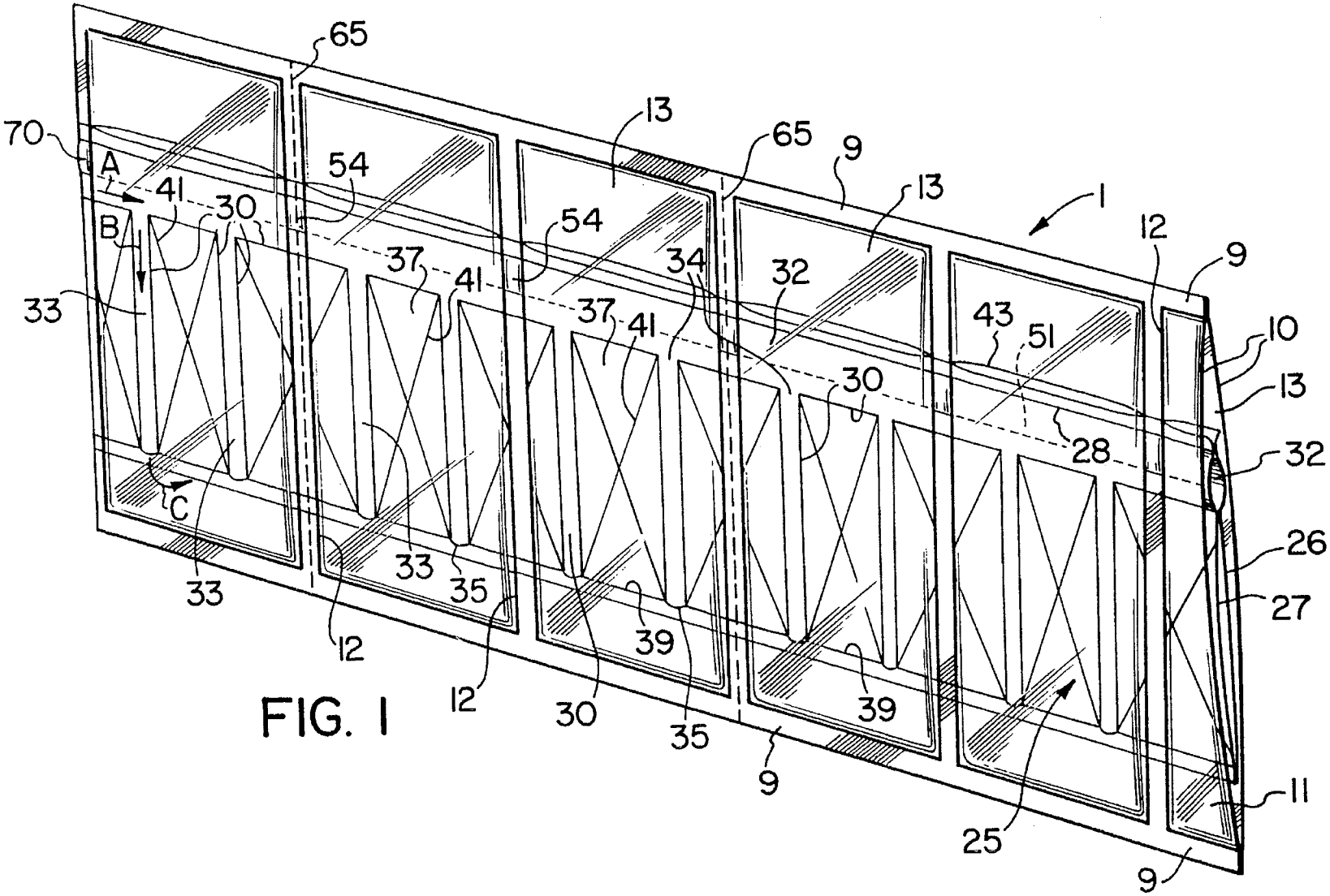
FIG. 1 is a perspective view of a multiple chamber inflatable package in accordance with the invention.
Figure 2:
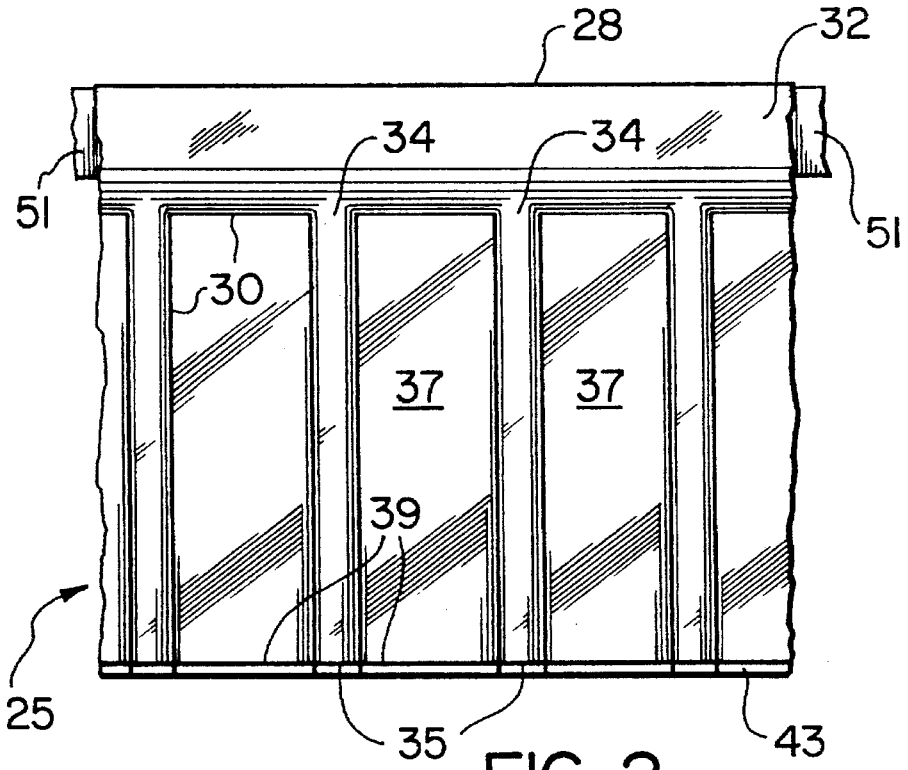
FIG. 2 is a side elevational view of a one-way multiple valve assembly forming part of the package of FIG. 1.

With reference to FIGS. 1 and 2, the present inflatable package 1 comprises two major components, namely an inflatable enclosure defined by outer walls 10 and a multiple one-way valve assembly 25 which permits the ingress of fluid into discreet pouches or chambers formed between walls 10 and which also acts to prevent the egress of that fluid once the chambers are inflated to the degree required.

Walls 10 may consist of opposed, typically rectangular layers of pliable plastic film 11 sealed such as by means of heat or adhesive at their peripheral edges 9 to form a strong fluid-tight bond therebetween. The walls are similarly bonded together at seams 12 to sub-divide the package into discreet fluid-tight chambers or pouches 13, which usually will be aligned orthogonally to the longitudinal axis of the package. In the alternative, films 11 may be printed with release coating in the areas representing chambers 13 so that the films can simply be fed between opposed heat sealers to cause the sealing together of only the uncoated areas of the films.

It will be appreciated that walls 10 need not necessarily be rectangular in shape, and the chambers themselves may assume other geometric configurations.

Figure 3:
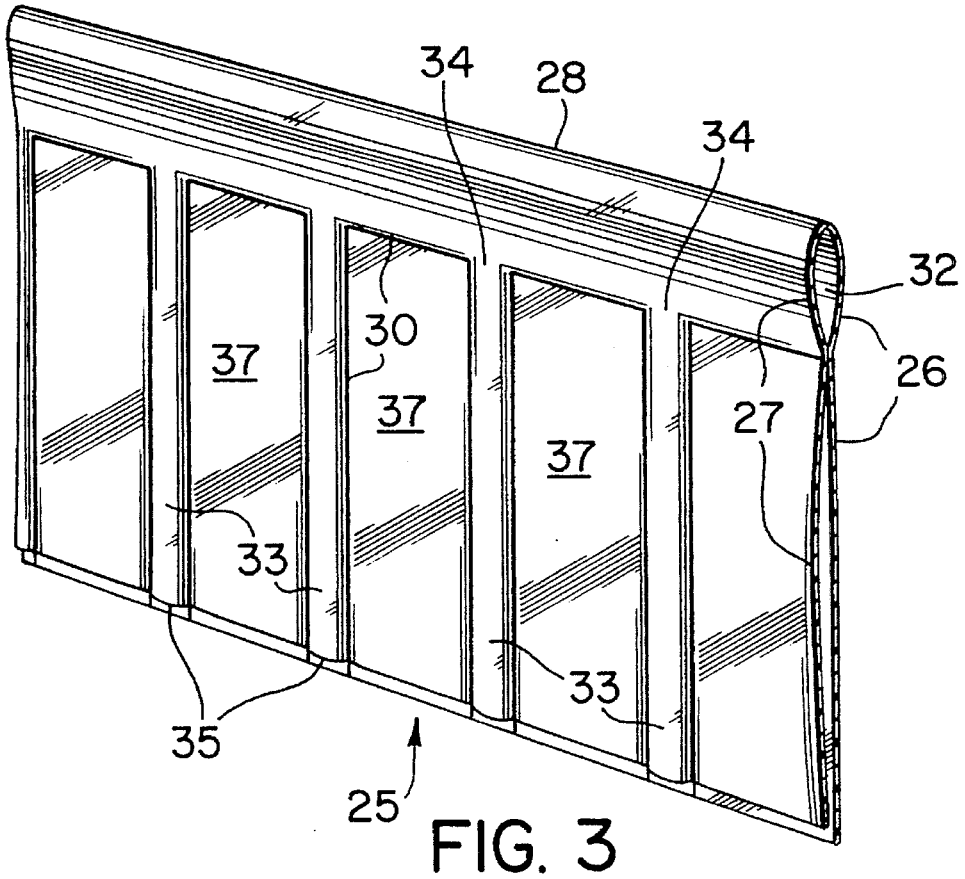
FIG. 3 is a perspective, partially sectional view of the valve of FIG. 2 in an internally pressurized condition.
Figure 4:
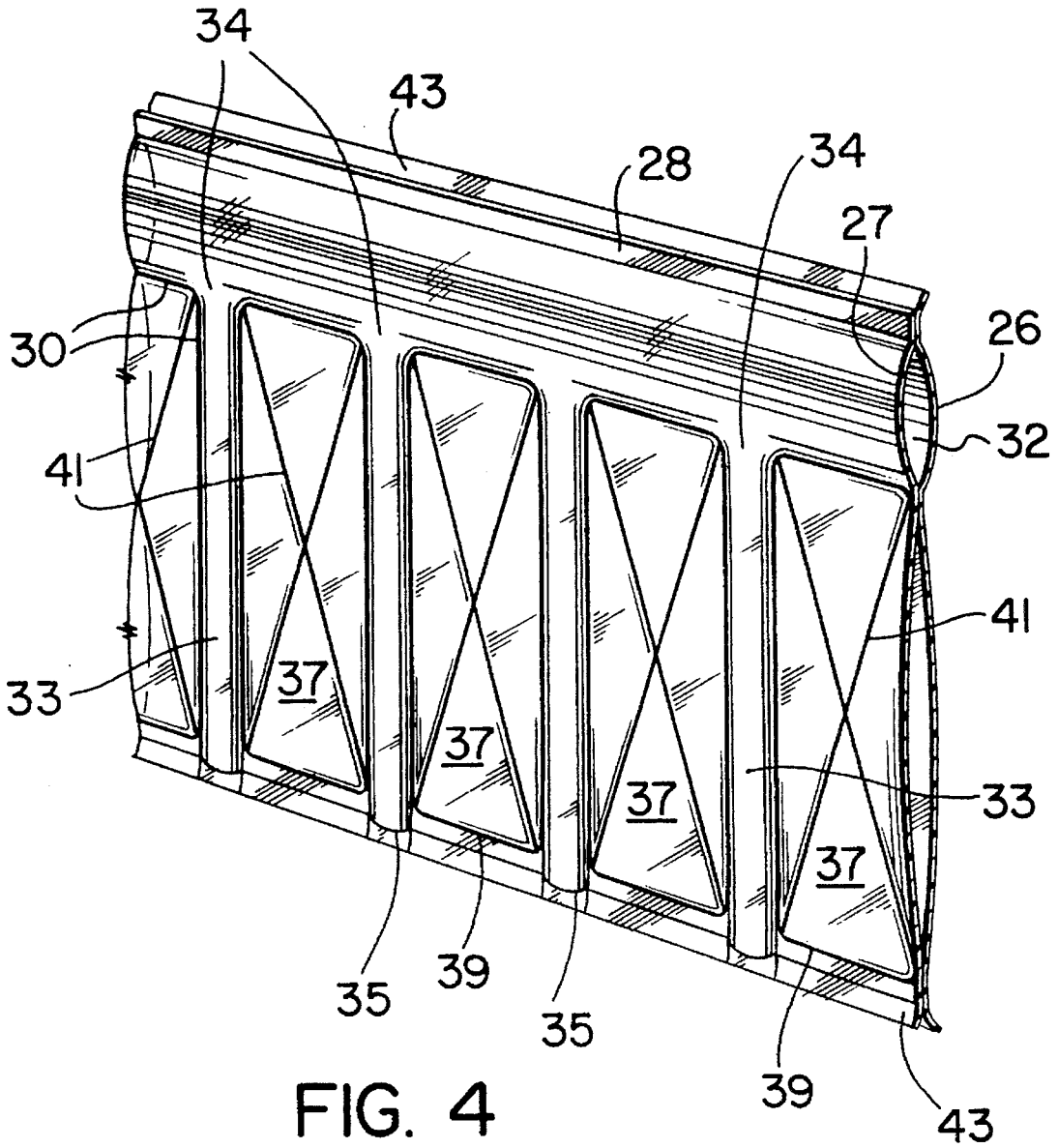
FIG. 4 is a perspective, partially sectional view of a modification to the valve of FIG. 3.

Prior to the sealing together of the walls 10, valve assembly 25 is placed between the opposed layers of film 11. As shown in FIGS. 3 and 4, valve 25 consists of two opposed strips of pliable plastic film 26 and 27 sealed together along upper peripheral edge 28 and internally as indicated by lines 30 to define an infinitely repeated inverted U-shaped pattern. The seals, which are fluid-tight, define a continuous longitudinally extending primary fluid duct or main artery 32 and a series of parallel, spaced apart, transversely extending flow channels 33, each of which is in fluid communication at its upstream end 34 with primary fluid duct 32 and at its downstream end 35 with the interior of a respective one of chambers 13. In one embodiment constructed by the applicant, channels 33 intersect duct 32 at a 90° angle.

Webs 37 formed between adjacent flow channels 33 are sealed along each of their adjoining edges with flow channels 32 and 33. Advantageously, the webs are also sealed along their lower edges 39 to prevent the ingress of fluid between strips 26 and 27 and may be additionally reinforced by an "X" shaped seal 41 made therein. Sealing of the valve in the manner described above is easily accomplished by a die which descends onto films 26 and 27 to apply enough heat to the edges and seams in question to permanently seal the two films together to form the pattern of ducts as described hereinabove. In the alternative, strips 26 and 27 may be printed with release coating and heat sealed to form the required end product.

Although strips 26 and 27 may comprise a single sheet of material folded over onto itself with upper edge 28 defining the fold line, a more reliably fluid-tight seal has been found to be formed if one of separate strips 26 or 27 is wider than the other from top to bottom, or the longitudinal edges of the two strips are offset or staggered a bit, to provide an overhang 43 (FIG. 4) at least at the upper but preferably at both the upper and lower edges of the valve. Advantageously as well, the rounding of the seams at the intersections of ducts 32 and 33 as shown most clearly in FIG. 4 appears to reduce material fatigue when the valve is under pressure.

After valve 25 has been interlayered between films 11, which is done without any particular regard or need to register the valve with or in relation to films 11 as will be described in greater detail below, the sealing together of the outer walls 10 can take place. A release coating applied internally in a continuous band 51 to strips 26 and 27 within primary fluid duct 32 prevents the inadvertent sealing of duct 32 at its points of intersection 54 with seams 12. The coating can be applied of course only to those parts of the duct intersecting with seams 12, but this would require that the valve be properly aligned with the seams prior to the application of heat.

Figure 6:
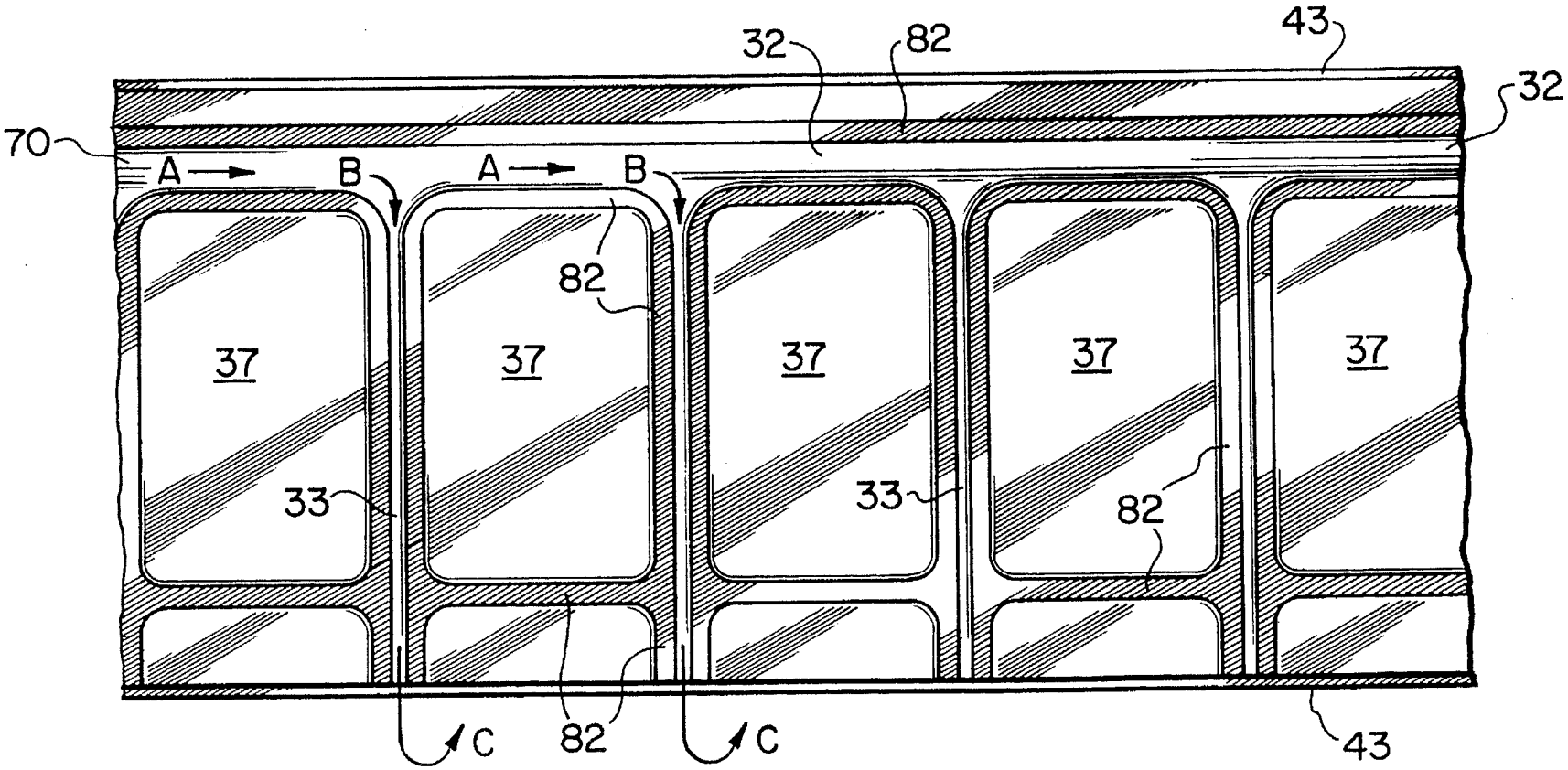
FIG. 6 is an elevational view of a further modification to the valve of FIG. 2.
Figure 7A:
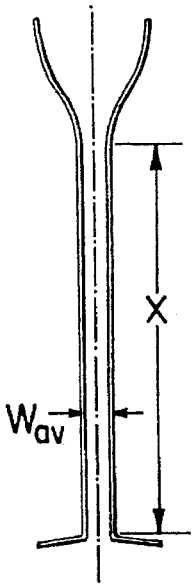
FIG. 7 is a schematical side elevational view of differently shaped flow channels.
Figure 7B:
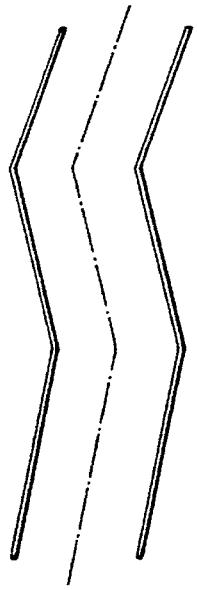
Figure 7C:
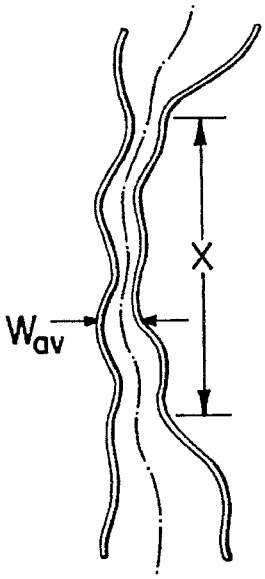
Figure 7D:
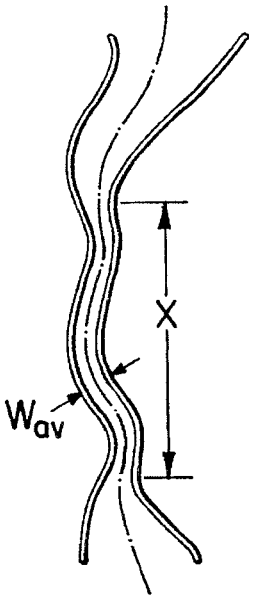

With reference to FIG. 6, there is shown a further slightly modified embodiment wherein like elements are identified by like reference numerals. As will be seen, ducts 32 and 33 and webs 37 are surrounded by a pattern of thickened seals 82 with the downstream ends of ducts 33 extending beyond (or below) the seals closing off the lower ends of the webs.

In use, fluid introduced under pressure at an upstream end 70 of primary duct 32 "inflates" the duct as the fluid travels downstream in the direction of Arrow A towards the next adjacent seam 12. Although the release coating has prevented duct 32 from being sealed completely closed at the intersection 54, nevertheless, it requires a pressure buildup to "pop" the intersection and before this occurs, the fluid will enter flow channels 33 as indicated by Arrow B, flowing therethrough into chamber 13 as indicated by Arrow C.

The fluid will then completely fill chamber 13 until the pressure buildup in the chamber and the pressure required to pop the seal at intersection 34 equalizes. When this occurs, the intersection will pop and fluid will flow downstream into the next adjacent chamber via duct 32 and channels 33 opening thereinto. This continues until as many chambers as are needed or required are filled. The filled portion of the package may then be detached along perforated lines 65 formed in seams 12 for this purpose. Alternatively, a cut using scissors or a sharpened edge can be made along the seam.

Intersections that "pop" under pressure may be undesirable in the event that the pressure required to cause the pop could exceed the burst strength of films 11 or strips 26 and 27 or the seams made therein. Accordingly, in an alternate embodiment, additional release coating or other seal preventing media is applied to the internal surfaces of duct 32 to prevent or at least minimize any closure of the duct at intersections 54. Fluid introduced at upstream end 70 will then travel the length of duct 32 without significant restriction. To accomplish the filling of the chambers, the intersection 54 immediately downstream of the last chamber to be filled is pinched off or held closed either manually or automatically by an apparatus (not shown) dispensing the uninflated packaging from a roll or sheets thereof. Typically, the last chamber will be the first to fill with successive upstream chambers filling in order thereafter.

Depending upon the width of chamber 13, one or more ducts 33 may open thereinto. In this regard, the spacing between adjacent flow channels is chosen to be less than the distance between mutually adjacent seams 12 to ensure that at least one flow channel will always be in communication with the interior of each chamber 13. For example, if the distance between the opposed edges of seams 12 is 2 inches, and the width of each flow channel is 0.290 inch, spacing the flow channels on 1.5 inch centres will ensure that at least one flow channel communicates with each chamber even if the next adjacent flow channel falls fully or partially under a seam 12. This staggered spacing of the flow channels relative to the chambers permits the random, non-registered, longitudinal alignment of the valve within outer walls 10 which has been found highly advantageous to the manufacturing process, particularly with respect to machine design, speed and costs.

When the supply of pressurized fluid is removed, the pressure in ducts 32 and 33 drops to atmospheric. This causes the ducts to physically collapse into a substantially flat condition under the pressure of the fluid in chambers 13 so that the walls of the ducts are actually compressed together in a suffocation effect to prevent the egress of fluid from the chambers. There will be a small amount of fluid leakage representing the fluid in the ducts at the moment of their collapse, but beyond this, the chambers will be sealed in a substantially fluidtight condition.

Figure 5:
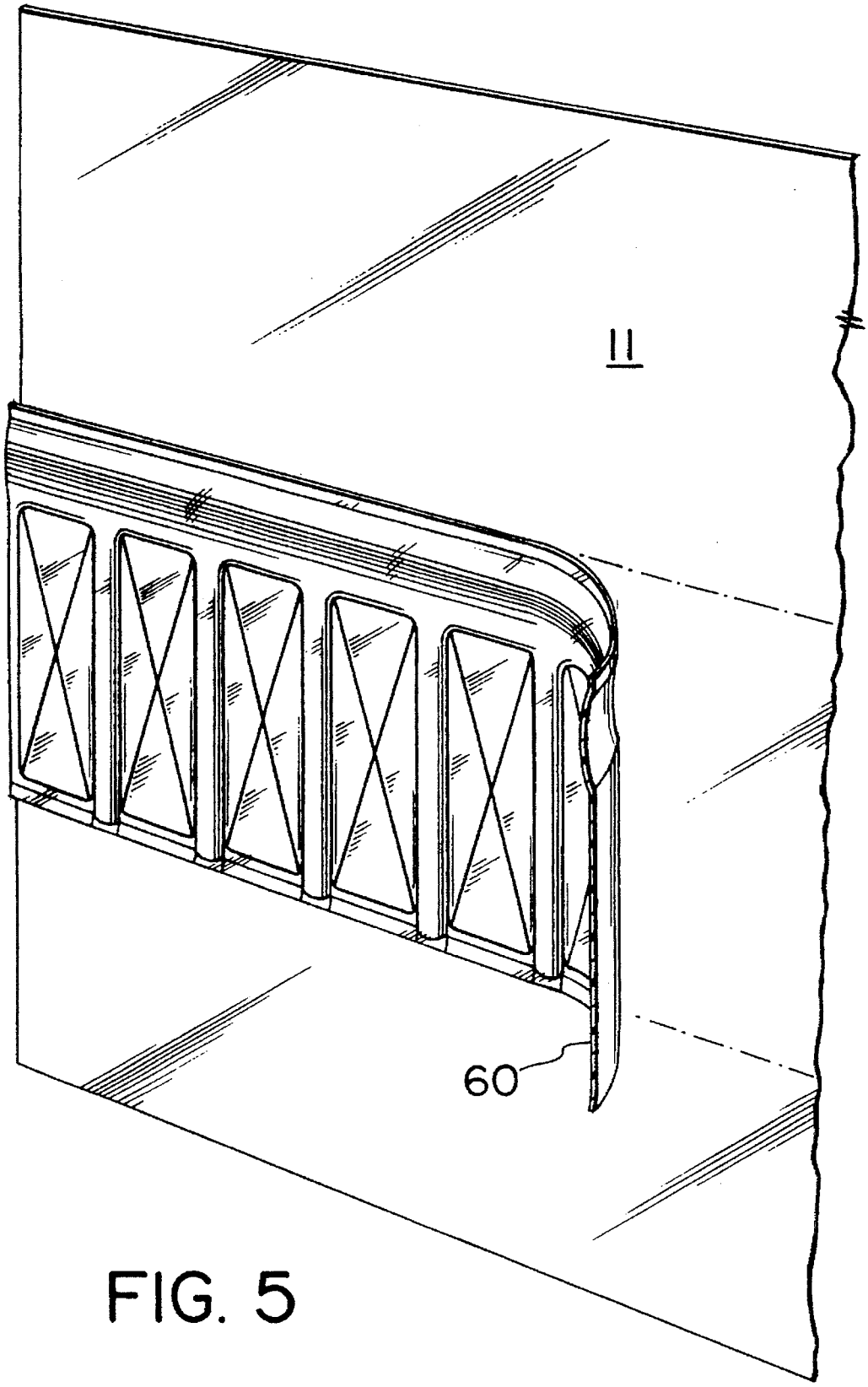
FIG. 5 is a perspective view of a further modification to the valve of FIG. 2.

With reference to FIG. 5, there is shown a modification in which valve 25 is formed by sealing a single strip of plastic film 60 directly to the inner surface of one of films 11. In other respects, this embodiment is the same as that described above with reference to FIGS. 1 to 4. This construction not only reduces the amount of plastic film needed to construct the valve, but results in a significant reduction in the stress to which the valve is subject when under inflation.

Suitable material useful for films 26 and 27 of valve 25 will include low slip 3 mil (nominal) polyethylene (LDPE and/or LLDPE and/or ULLDPE blend)/nylon (HDPE or MDPE) middle layer/polyethylene (LDPE and/or LLDPE and/or ULLDPE blend) co-extrusion with no additives or surface energy treatment. Monolayer blown films may also be suitable.

For films 11, suitable materials will include 3 to 6 mil (nominal) polyethylene (LDPE and/or LLDPE and/or ULLDPE blend)/nylon (HDPE or MDPE or EVOH) middle layer/polyethylene (LDPE and/or LLDPE and/or ULLDPE blend) co-extrusion with no surface energy treatment on the sealing side of each film. Monolayer blown films may also be suitable.

It is anticipated that the present package will be manufactured in strips for winding onto rolls or cut and packed as sheets. Chamber widths will vary from a minimum of a fraction of an inch on up. Product height may again vary in a wide range from a few inches to a few feet or more. Outer walls 10 may be clear or opaque and may be printable for logos, trade-marks and the like.

Chambers 13 can be filled with air for packing or insulating purposes. Water can be used for freezing the package into ice packs.

Other fluids than can be used include commercially available gels useful for either cooling or heating purposes. As many chambers as are needed can be torn off to form a pack as large or as small as may be required. The package can be reused or disposed of when done with.

For packaging purposes, a strip made into a closed loop if desired can be used for wrapping a television, computer or a similarly fragile commodity and then inflated, or inflated prior to packing. This will at once conform the shape of the strip to the merchandise being wrapped and will cause the package to constrictively engage the merchandise to prevent slipping. Linear strips can be used for stuffing between the package walls and the enclosed goods. Pouches or pockets can be formed for enclosing smaller goods. The packing will not of course settle and even if the odd chamber is punctured, this will not result in leakage from adjoining chambers and product integrity will be substantially maintained.

Key to this product's successful adaptation is long term fluid retention and leak prevention. Apart from outright puncture, fluid losses will occur primarily as a result of inadequate suffocation of main artery 32 and flow channels 33 and/or leakage due to stress induced failures in the junctions between valve 25 and outer films 11 caused by high energy fluid flow as air (or other liquids) is being introduced into artery 32 and sustained elevated fluid pressures in chamber 17 following inflation.

Design emphasis on reducing internal stress has been found therefore to be of considerable importance and is something in respect of which the prior art demonstrates little concern. Without effective stress relief, combined with optimum suffocation of the valve, retention of pressurized air for indefinite periods of time may not be possible.

It has been found that proper suffocation requires that there be sufficient free length of the primary artery and particularly of the secondary flow channels 33 exposed to the internal inflated pressure of the package. More specifically, as this free length is represented primarily by flow channels 33, optimal results are obtained if these channels are relatively long compared to their width. It has been found that valve structures comprised of pliable films are subject to high stress levels caused by the flow of pressurized air therethrough and the turning of the air into the flow channels. The flow of pressurized air can cause deformation past the film's yield point (i.e., permanent stretch) resulting in permanent micro-creases in the valve following collapse. Micro-creases will permit micro-leakage resulting over time in deflation. The formation of micro-creases can be limited or at least the effect of micro-crease formation, can be limited if the flow channels are formed having a high aspect ratio measured as a function of length over width. In one embodiment constructed by the applicant, good results have been obtained from flow channels four (4) inches in length compared to 0.290 inches in width for an aspect ratio of approximately 13.8:1.

More specifically, ideal flow channel width may vary from a minimum of approximately 0.250 inches to a maximum of approximately 0.350 inches. Below 0.25 inches, high stress levels due to back pressure and poor air flow characteristics can be encountered. Above 0.350 inches, the rate of micro-crease formation can approach unacceptable levels. Despite these drawbacks, it's still possible to create flow channels having widths ranging from a minimum of 0.200 inches to a maximum of 0.450 inches. Outside of this range, inflation times and rates of leakage will increase to levels that can compromise commercial viability.

Assuming flow channel width is maintained in a more ideal range of 0.250 ($W_{min}$) to 0.350 ($W_{max}$) inches, flow channel lengths may similarly vary in the range of 1.75 ($L_{min}$) to 7.00 ($L_{max}$) inches for aspect ratios varying from $L_{max}/W_{min}$ to $L_{min}/W_{max}$, where W equals flow channel width and L equals flow channel length.

Obviously, flow channels can vary almost infinitely in shape with some possible examples shown with reference to FIG. 7. Although some of these shapes may well be impractical from a manufacturing point of view, such shapes will nevertheless provide effective suffocation provided that the ratio of length to width is calculated using not the width from either the widest or narrowest point of the channel, but rather an average width $W_{av}$ taken along a section (or sections) x having a more or less uniform cross-sectional width $W_{av}$, and comparing that average width to the length of section x over which that average width prevails. Thus, with reference to flow channel (c) in FIG. 7, there will be good suffocation within the intent of the present invention if the aspect ratio determined by length $L_x$ of section x divided by average width $W_{av}$ along section x falls within the range specified above, where $W_{av}$ falls within the range of 0.200 inches to 0.450 inches or, more ideally, within the range of 0.250 to 0.350 inches, and $L_x$ falls within the range of 1.75 to 7.0 inches. Obviously, if $W_{av}$ tends towards the higher end of the range it will be preferable that $L_x$ should also tend toward the higher end of its range.

Figure 8:
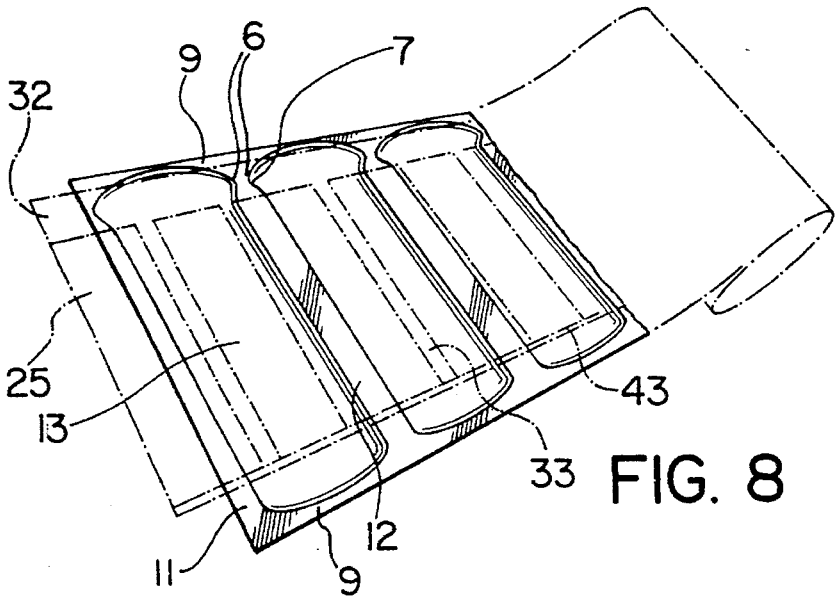
FIG. 8 is a side elevational view of a modified embodiment of the present package.
Figure 9:
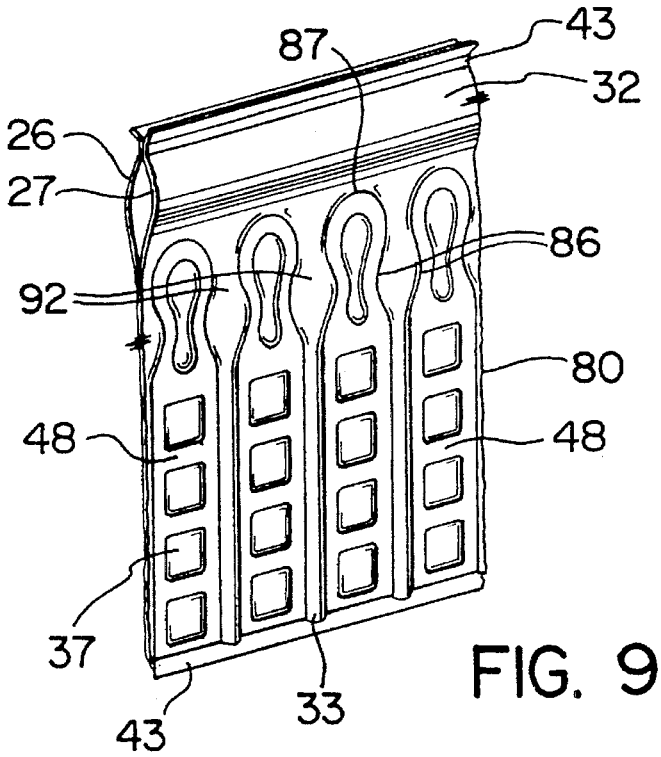
FIG. 9 is a side elevational view of a modified valve forming part of the package.

With reference to FIGS. 8 and 9, there are shown a number of improvements intended to reduce internal stress in the package. As aforesaid, stress reduction has been found to reduce air losses causing deflation over extended periods of time in a static situation, and also tends to distribute dynamic forces due, for example, to impact, more evenly along seams 9 and 12.

In previous FIGS. 1 to 6, chambers 13 are shown to be generally rectangular in outline when in a deflated condition. The angle of intersection between seams 12 forming the outer edges of chambers 13 and main artery 32 is therefore 90°. The corners of the chambers are also defined by 90°. When the chambers are inflated, there is a natural tendency for the junctions between seams 12 and the main artery, and the corners of each chamber to cone as the chamber takes shape under inflation. The corners and the junction with the main artery are therefore stress points where fluid leakage can occur.

With reference to FIG. 8, the stress at these positions has been found reducible by changing the outline of seams 12 to resemble laterally extending V-or chevron-shaped portions 6, the oppositely extending apices 7 of which are centred over the longitudinal axis of main artery 32. These V-shaped seams over the artery reflect the geometry outer films 11 naturally want to assume upon inflation of chambers 13, and this design has therefore been found effective to relieve both static and dynamic stress occurring at the intersection between valve 25 and seams 12 when main artery 32 is open to atmospheric pressure.

A corollary benefit of the chevrons is that the collapsible free length of artery 32 within each chamber is increased by the additional distance between opposite apices 7 which extends the free length of the artery beyond seams 12. This in turn provides better sealing of the valve following inflation of the package.

It is contemplated that the shape of seams 6 may include other configurations including arcs, semi-circles and frustocones, all of which can be arranged to extend laterally outside seams 12.

Internal stresses can be further reduced if upper and lower seams 9 defining the top and bottom edges of each chamber are rounded convexly outwardly as shown in FIG. 8. It will be seen that seam 9 at the top of each chamber merges convexly smoothly with chevrons 6, witht the chevrons then merging concavely smoothly into seams 12. Similarly, seam 9 at the bottom of each chamber also merges convexly smoothly into lateral seams 12. This rounding has been found effective to further reduce both static and dynamic stress at the junctions of seams 9 and 12.

It has been further recognized by the applicant that additional reductions in internal static stress are possible by means of positioning valve 25 within outer films 11 so that main artery 32 lies as close as possible to upper seam 9, leaving only sufficient clearance for centring of chevron 6 over the artery as shown most clearly in FIG. 8.

As mentioned previously, considerable stress is induced within valve 25 as a result of pressurization during inflation of chambers 13. Initially, the pressurization of main artery 32 along its length for the required number of chambers to be filled induces relative little stress. The problem mainly arises following complete pressurization of the main artery when considerable back pressure (hoop stress) occurs as the air then attempts to make the 90° transition into flow channels 33. Without proper airflow management through the primary and secondary arteries, particularly when the two channels intersect at sharp 90° corners, there is a high likelihood of a high pressure turbulent flow transition into the flow channels sufficient to stretch the valve material to cause micro-creases and even micro-pores that result in leaks. Ideally, there should be laminar flow in main artery 32 with a smooth, lower velocity laminar flow 90° transition into flow channels 33.

With reference to FIG. 9, there is shown a modified valve 80 similar to valve 25 described above with reference to FIG. 4, and wherein like elements have been identified using like reference numerals. Unlike the previously described valve however, within valve 80 each flow channel 33 additionally includes a widened opening or back pressure bell 92 at the intersection with artery 32. The shape of each bell 92 is defined by fluid tight seals 86 which also define the series of parallel, spaced apart flow channels 33 just as with the valve of FIG. 4. As will be seen from FIG. 9, seals 86 are formed to provide a rounded transition 87 into each bell 92, with the bell then narrowing and merging smoothly into flow channels 33. Webs 37 formed between adjacent flow channels 33 are additionally reinforced by means of ribs 48 for added physical strength and to minimize the formation of microcreases that might possibly result due to the greater width of the plastic films forming the valve across bells 92.

As with the valve of FIG. 4, one of films 26 or 27 is wider from top to bottom than the other, or the two films are slightly offset one to the other, to form an overhang 43 which has been found to significantly improve the sealing of flow channels 33 when the flow of pressurized air is removed to cause collapse and suffocation of the valve. Moreover, the staggering of films 26 and 27 as represented by overhangs 43 is felt to improve sealing of seams 12 at the intersection with the upper and lower edges of the valve. Because of the staggering of films 26 and 27, films 11 along seam 12 seal with one film thickness (one of films 26 or 27) at a time rather than with both of films 26 and 27 at once, which is felt to result in a more fluid tight seal.

It has been found that bells 92 relieve high energy stress due to back pressure arising during inflation. The rounded or sloped entrance into each bell is thought to slow air speed down to limit the turbulence during the 90° transition into the flow channels. The bells additionally are thought by applicant to accumulate this high energy flow before transition into flow channels 33. This therefore dissipates the energy from turbulent back to laminar flow allowing a smoother lower velocity transition into the flow channels without stretching films 26 or 27 to the point of permanent deformation.

The shape of bells 92 as shown in FIG. 9 is intended to be exemplary only. Other shapes which accumulate or trap turbulent or high pressure air flow for a lower pressure transition into the relatively narrower flow channels 33 are possible.

Figure 10:
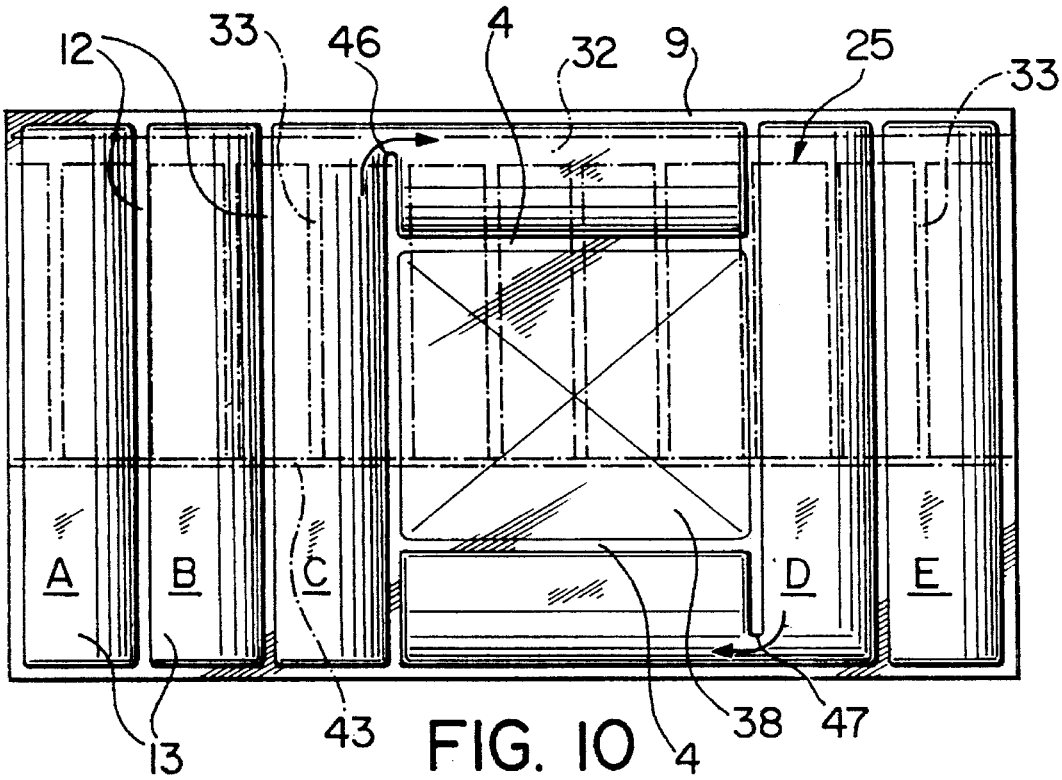
FIG. 10 is a side elevational view of a package further modified to include transverse seams.
Figure 11:
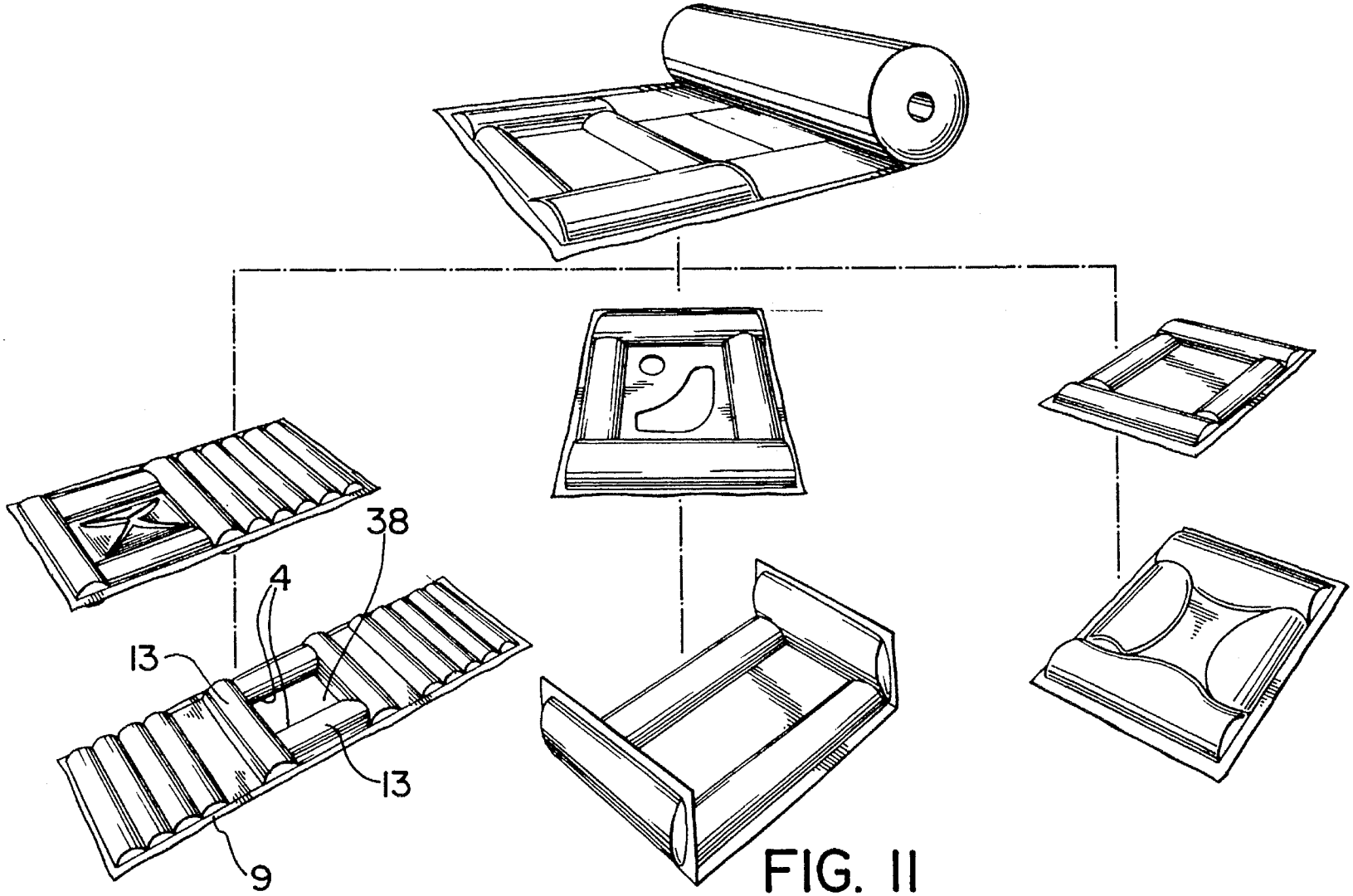
FIG. 11 is a perspective view showing modified outer package geometries.
Figure 12:
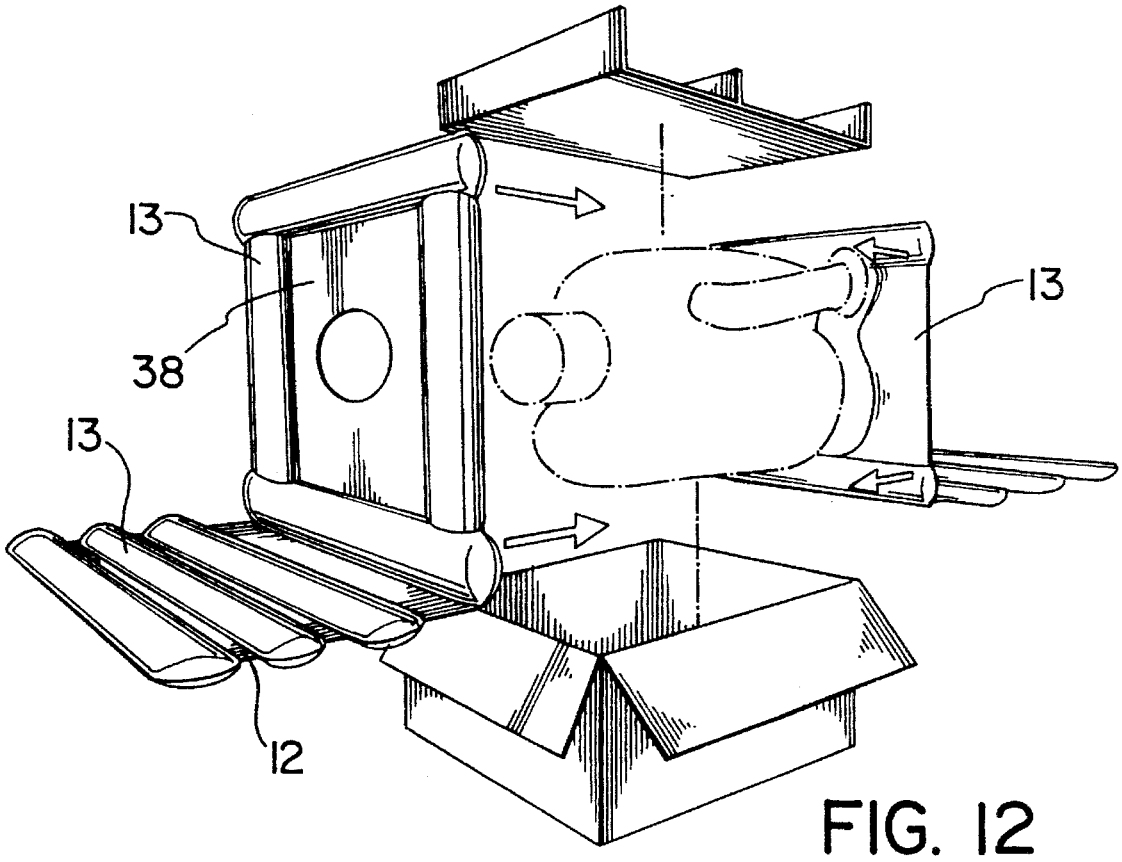
FIG. 12 is a perspective view showing the use of a modified package to pack an odd-shaped item.

With reference now to FIGS. 10 to 13, there is shown a variation of the present package where, instead of an arrangement of simple side-by-side chambers 13 (or "hot dogs"), there can be formed different structures such as "trampolines" useful, for example, to package odd-shaped items such as shown in FIG. 12.

Figure 13:
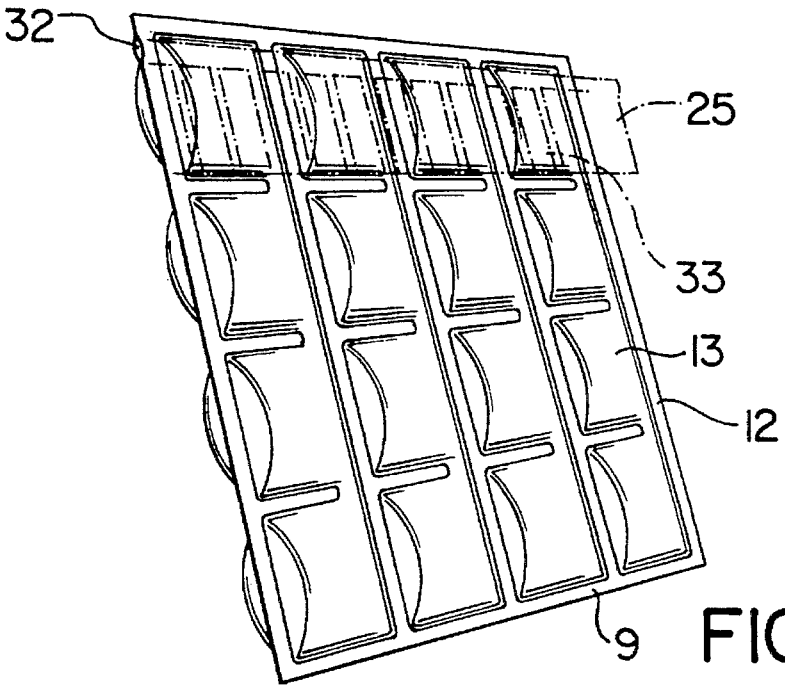
FIG. 13 is a perspective view of yet another modified geometry of the outer package.

With specific reference to FIG. 10, showing chambers 13 without chevrons 6 or the rounding of seams 9 and 12 for purposes of clarity, valve 25 and chambers A, B and E are shown to have conventional geometry described above with respect, for example, to the embodiment of FIG. 1. However, by shortening the seams 12 at points 46 and 47 along the inner opposed edges of chambers C and D so as not to intersect with seams 9, and by adding transversely extending seams 4, the package will, when inflated, appear as shown in FIG. 11. The web 38 making up the center of the trampoline can be left intact to cradle packaged items, or it can be cut out into any required shape to form a collar for the packaging of items such as shown in FIG. 12. It should be noted that notwithstanding the substantial alteration to the outer geometry of the resulting package, no change to valve 25 is required. This universality of valve 25 to a variety of different outer geometries, another example of which having a "quilted" appearance is shown in FIG. 13, is considered a desirable aspect of the present invention.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. An inflatable package comprising:

outer pliable walls of indefinite length, said walls being joined along their opposed longitudinal edges and along spaced apart seams extending transversely between said longitudinal edges thereby defining a plurality of chambers of predetermined width between said outer walls; and valve means disposed in longitudinal alignment between said outer walls for permitting the ingress of pressurized fluid into said chambers, said valve means comprising opposed layers of pliable film sealed together to define therebetween a primary fluid duct extending continuously along the length of said valve means, and a plurality of spaced apart flow channels intersecting said primary duct at an angle to extend transversely from said primary duct, a respective at least one of said flow channels placing said primary duct in fluid communication with the interior of respective ones of said chambers, said primary duct and flow channels being collapsible into a substantially flattened sealed condition when the ingress of pressurized fluid terminates to prevent the egress of said fluid from said chambers;

the orthogonal distance between centres of adjacent flow channels being equal and sufficiently less than the width of respective ones of said chambers so that each of said chambers is placed in fluid communication with said primary duct via at least one of said flow channels without need of registration of said flow channels relative to said chambers.

2. The package of claim 1 wherein said flow channels are long and narrow for enhanced sealing thereof when the ingress of pressurized fluid is terminated.

3. The package of claim 2 wherein said flow channels each include at the intersection with said primary duct a widened portion extending from said primary duct at least partially along the length of each said flow channel.

4. The package of claim 3 wherein said widened portion at one end thereof merges with said primary duct at rounded corners and narrows at an opposite end thereof for a smooth transition into said flow channel associated therewith.

5. The package of claim 4 wherein said widened portion facilitates a lower velocity transition of said pressurized fluid into said flow channels.

6. The package of claim 2 wherein the length of said flow channels, exclusive of any widened portions therein, varies within the range of 1.75 to 7 inches, and the width thereof, exclusive of any widened portions therein, varies within the range of 0.2 to 0.45 inches.

7. The package of claim 6 wherein the width of said flow channels varies within the range of 0.250 to 0.350 inches.

8. The package of claim 7 wherein the width of said flow channels is 0.290 inches.

9. The package of claim 1 wherein said primary duct includes means therein to prevent the permanent closure thereof at points where said primary duct intersects with said seams.

10. The package of claim 9 wherein said seams at said points of intersection are shaped to allow a reduction in the stress in said outer walls caused by inflation thereof.

11. The package of claim 10 wherein said seams at said points of intersection extend laterally outwardly relative to the interior of said chamber bounded thereby.

12. The package of claim 11 wherein said laterally extending seams are generally V-shaped, the apex of said V-shape being centred over the longitudinal axis of said primary duct.

13. The package of claim 12 wherein the edges of each of said chambers defined by said joining of said longitudinal edges of said outer walls are rounded convexly outwardly.

14. The package of claim 13 wherein said seams and said rounded longitudinal edges merge convexly smoothly into one another so that the corners of each said chamber, when not inflated, are rounded.

15. The package of claim 9 wherein said means to prevent closure comprise coating means on inner surfaces of said primary duct at least at said points of intersection with said seams.

16. The package of claim 1 wherein said valve means are comprised of not more than two opposed continuous strips of pliable film, each of said strips having longitudinally extending upper and lower edges, said at least two pliable films being arranged so that said longitudinal edges are slightly laterally offset one relative to the other in a staggered relationship.

17. The package of claim 16 wherein said flow channels intersect said primary duct at an angle of 90°.

18. The package of claim 1 wherein said primary duct and said flow channels are formed between a strip of said pliable film sealed directly to an inner surface of one of said outer walls.

19. The package of claim 1 wherein said valve means are positioned between said outer walls with said primary duct positioned within said outer walls immediately adjacent one of said joined longitudinal edges thereof.

* * * * *